US009801510B2

(12) United States Patent
Weiburg et al.

(10) Patent No.: US 9,801,510 B2
(45) Date of Patent: Oct. 31, 2017

(54) VACUUM SYSTEM AND DEVICE

(71) Applicants: Anthony Weiburg, Staten Island, NY (US); Janet Weiburg, Staten Island, NY (US)

(72) Inventors: Anthony Weiburg, Staten Island, NY (US); Janet Weiburg, Staten Island, NY (US)

( * ) Notice: Subject to any disclaimer, the term of this patent is extended or adjusted under 35 U.S.C. 154(b) by 413 days.

(21) Appl. No.: 14/505,628

(22) Filed: Oct. 3, 2014

(65) Prior Publication Data

US 2016/0095482 A1 Apr. 7, 2016

(51) Int. Cl.

| | |
|---|---|
| ***A47L 5/14*** | (2006.01) |
| ***A47L 9/08*** | (2006.01) |
| ***A47L 5/38*** | (2006.01) |

(52) U.S. Cl.

CPC *A47L 5/14* (2013.01); *A47L 5/38* (2013.01); *A47L 9/08* (2013.01)

(58) Field of Classification Search

CPC ..... A47L 5/14; A47L 5/38; A47L 9/08; A47L 11/34; A47L 11/4044; A47L 11/4088; A47L 9/02

See application file for complete search history.

(56) References Cited

U.S. PATENT DOCUMENTS

| | | | | |
|---|---|---|---|---|
| 2,731,194 | A | 1/1956 | Kent | |
| 3,694,848 | A * | 10/1972 | Alcala | A47L 9/08 15/346 |
| 4,751,759 | A * | 6/1988 | Zoell | A47L 5/14 15/1.51 |
| 6,324,722 | B1 | 12/2001 | Takemoto | |
| 7,458,130 | B1 * | 12/2008 | Krymsky | A47L 5/14 15/345 |
| 8,719,997 | B1 | 5/2014 | Nathenson et al. | |
| 2003/0126715 | A1 * | 7/2003 | Krymsky | A47L 9/08 15/346 |
| 2003/0145418 | A1 * | 8/2003 | Ikeda | B08B 1/04 15/345 |
| 2007/0234504 | A1 | 10/2007 | Bott et al. | |
| 2012/0260454 | A1 * | 10/2012 | Lester | A47L 9/08 15/327.1 |

* cited by examiner

*Primary Examiner* — Dung Van Nguyen
(74) *Attorney, Agent, or Firm* — Michael J. Feigin, Esq.; Feigin and Fridman LLC

(57) ABSTRACT

A vacuum producing suction and air blowing simultaneously at a same surface of the device, is disclosed here in. A pump and compressor work simultaneously to both blow and suck air through a dual-line hose. A pressure gradient is created between the surface of the device and a surface being cleaned, due to high pressure being created by the air blowing, and low pressure being created by the air sucking. This causes dust, dirt, and the like to be pulled from the surface being cleaned and sucked in a suction portal, and into a suction line of the dual-line hose. This can be accomplished with a central vacuum system or standalone vacuum.

18 Claims, 9 Drawing Sheets

VACUUM SYSTEM AND DEVICE

FIELD OF THE DISCLOSED TECHNOLOGY

The disclosed technology relates generally to vacuum systems, and more specifically, towards a vacuum employing both a blowing and suction mechanism.

BACKGROUND OF THE DISCLOSED TECHNOLOGY

A typical vacuum system, known in the art, utilizes suction to pull dirt and dust into the device. A rotary bar is additionally used to agitate and lift up the dirt from the surface being cleaned. In an effort to increase the effectiveness of vacuum cleaners, manufacturers are placing the rotary bar closer to the ground. The rotary bar can vibrate closely against the surface in the hope that a larger amount of dirt will lift up closer to the portion of the vacuum producing suction. However, in attempting to suction more dirt into the vacuum, the rotary bar can cause damage to the surface being vacuumed. For example, a large portion of fibers sucked into the vacuum are carpet fibers fragmented and crushed by the rotary bar. At times, these ground up carpet fibers can be spewed around the surface being cleaned. An additional drawback of the existing vacuuming technique is that the rotary bar does not effectively lift up dirt, even when close to the ground or may become clogged with hair and other debris. Small streams of air, produced by the turning rotary bar, can also disrupt the suction between the vacuum and the surface being cleaned.

Therefore, there exists a need for a system and device which increases suction efficiency, and effectively suctions dirt from a surface without causing further damage.

SUMMARY OF THE DISCLOSED TECHNOLOGY

It is therefore an object of the disclosed technology to provide a vacuum system that increases the efficiency of the vacuum motor producing suction. In some embodiments, it is further desired to do so without increasing the size of the motor and without causing damage to carpets or other surfaces. It is a further object to utilize Bernoulli's Principle (stating that as the speed of moving particles increase, the pressure within the particles decrease) to increase suction efficiency by producing a pressure gradient focusing from a wide area with air blowing outward toward a narrow area to lift up dirt and direct dirt toward the narrow suctioning portion of a vacuum of the disclosed technology.

In one embodiment of the disclosed technology, a vacuum/vacuum system is claimed that includes a vacuum pump and compressor. A "compressor," for purposes of this disclosure, is any device which creates a pressurized flow of air and can include a booster motor. A first pipe and a second pipe are or can be operatively connected, to the vacuum pump and compressor, respectively, at a first end of each pipe. The two pipes are or can be further operatively connected to a first and second portal, respectively, at a second end of each pipe. The first portal and the second portal open on a same side of a business end of a vacuum cleaner. A "pipe," for purposes of this disclosure, is defined as a length of hollow, elongated tube in which gases, liquids, and/or solids substantially flow from a first opening therein to a second opening therein. Such a pipe may be rigid, flexible, or a combination of both flexible pipe and rigid pipe. A "compressor," for purposes of this disclosure, is a device that converts power, such as by way of an electric motor, into kinetic energy by compressing and pressurizing air. A "vacuum pump," for purposes of this disclosure, is a device that lowers the air pressure in a volume of gas by removing some of the gas there-from. The "vacuum pump" may further be defined as a device which removes gas molecules from a volume in order to leave behind a partial vacuum.

Still discussing the present embodiment, a direction of airflow at the first portal is opposite a direction of airflow at the second portal at a working end or business end of a vacuum cleaner, such that the first portal blows air and the second portal sucks air. The business end further includes a vacuum base having a generally linear surface. The first portal and the second portal open into the generally linear surface of the vacuum base substantially transverse to the plane of the generally linear surface, while the portals are substantially planar to each other. In embodiments, the vacuum base has a designated front and back side thereof, such that the second portal (blowing portal) is positioned closer to the front side of the vacuum base than the first portal (suction portal). The generally linear surface rests substantially on or parallel to a surface being cleaned.

In embodiments, the second portal (suction portal) is operatively connected with the vacuum piping, such that air is pulled from the second portal toward the vacuum pump. The first portal (blower portal) of the vacuum is operatively connected with the air blowing piping, such that air is sent from the compressor toward the first portal. In further embodiments, the generally linear surface includes a single second portal (for suction), situated along a front portion of the generally linear surface and three first portals positioned opposite on the back portion of the generally linear surface. In embodiments, the first portals and the single second portal create a triangular pressure region focusing a pressure gradient from a wide surface region to a narrow surface region. A greater suction gradient is produced at the narrow surface region, the location of the second portal, than at the wide surface region, the location of the three first portals.

In embodiments, the suction gradient produced at the suction portal location is produced between the generally linear surface of the base and the ground, such that the suction gradient is stronger than the pressure gradient produced at the location of the three air blowing portals, the pressure gradient being produced between the generally linear surface and the ground. Still in further embodiments, the pressure gradient produced at the location of said three air blowing portals is produced between the generally linear surface and the ground, such that the pressure gradient is stronger than the suction gradient produced at the location of the suction portal, the suction gradient being produced between the generally linear surface and the ground.

In a further embodiment of the disclosed technology, a vacuum additionally includes a wall mounted vacuum port and a wall mounted air blowing port. A dual line hose attachment having a vacuum hose, an air blowing hose, and the vacuum base are included in this embodiment as well. The dual line hose, in embodiments, can form a unitary single hose with two distinct air passageways therein. Parts of the hose or hoses may be rigid, and parts may be flexible. A first end of the vacuum hose operatively attaches to the wall mounted vacuum port, and a second end of the vacuum hose operatively attaches to the second portal on the generally linear surface of the vacuum base. A first end of the air blowing hose operatively attaches to the air blowing port, and a second end of the air blowing hose operatively couples to the first portals on the generally linear surface of the vacuum base.

In yet a further embodiment, a central vacuum system has a vacuum pump operatively connected to vacuum piping, and a vacuum compressor operatively connected to air blowing piping. The vacuum system further includes a storage container operatively placed between the vacuum piping and wall mounted vacuum and air blowing ports. A dual line hose attachment is included, such that a first line of the dual line hose is or can be operatively connected with the wall mounted vacuum port, and a second line of the dual line hose is or can be operatively connected with the wall mounted air blowing port.

Still discussing the present embodiment, a handle can attach to the dual line hose attachment at a location between the wall mounted vacuum port and a vacuum base, such that the vacuum base has a generally linear surface. In embodiments, a handle location can be situated between the wall mounted vacuum port and the base, such that the dual line hose, itself may form the handle. A "handle" is defined as a part which is held or directly manipulated by a user of vacuum systems of embodiments of the disclosed technology. A suction portal opens into the generally linear surface and is or can be substantially transverse thereto. The suction portal is or can be operatively connected to the first line of the dual line hose and to the vacuum pump. In embodiments, at least one air blowing portal opens into the generally linear surface and is or can be substantially transverse thereto and substantially planar with the suction portal. The air blowing portal is or can be operatively connected to the second line of the dual line hose and to the compressor.

In embodiments, the vacuum base includes a designated front and back side thereof, and the suction portal is closer to the front side of the vacuum base than the at least one air blowing portal. An angle of the vacuum base and the dual line hose attachment are adapted such that a person holds the handle on a back side of the vacuum base, and the air blowing portal is situated on the vacuum base closer to the back side than the suction portal, in embodiments of the disclosed technology. This angle may be determined by a rigid portion of a hose, such that an end of a rigid portion is angled downwards towards the ground relative to a base of the vacuum on the ground, defining a rear of the device. In embodiments, the generally linear surface further includes three air blowing portals positioned on the back portion of the generally linear surface, positioned opposite of a single suction portal that is situated along a front portion of the generally linear surface. The air blowing portals and the suction portal create a triangular pressure region focusing a pressure gradient from a wide surface region to a narrow surface region, in embodiments.

A greater suction gradient is produced at the narrow surface region, the location of the suction portal, than at the wide surface region, the location of the three air blowing portals. In embodiments, a net gain of air pressure due to air flowing out of the at least one air blowing portal and into the suction portal is a maximum of zero. In embodiments, the dual line hose attachment further includes one or a plurality of wheels extending past the generally linear surface. When each wheel is engaged with the ground, an equal distance between the ground and each of the suction portal and the air blowing portals is formed.

In a further embodiments, a vacuum includes a top portion having a handle, disposed on an opposite side of a vacuum base with a vacuum body there-between. The vacuum includes a vacuum pump operatively connected to vacuum piping, and a vacuum compressor operatively connected to air blowing piping. A storage container is or can be operatively placed between the vacuum pump and the vacuum piping. At least one suction portal opens into a bottom generally linear surface of the base and substantially transverse thereto. At least one air blowing portal open into the generally linear surface of the base and is or can be substantially transverse thereto. A net gain of air pressure due to air flowing out of the at least one air blowing portal and into the at least one air suction portal is or can be a maximum of zero. The suction portal of the vacuum is operatively connected with the vacuum piping, such that air is diverted from the suction portal toward the vacuum pump. The air blowing portal of the vacuum is operatively connected with the air blowing piping, such that air is diverted from the vacuum compressor toward the air blowing portal.

In embodiments, the base is or can be designated a front and back side thereof, and, in such embodiments, the suction portal can be or is closer to the front side of the base than the air blowing portal. The front and back sides can be defined/designated by an angle of the base and the vacuum body, relative to each other, such that a designated position for a person to hold the handle and/or a part of a hose is closer to the back side of the base. The air blowing portal is situated on the base closer to the back side than the suction portal. In embodiments, the base has one or a plurality of wheels extending past the generally linear surface, such that when each wheel is engaged with the ground, an equal distance between the ground and each of the suction and air blowing portals is formed.

The term "substantially" is defined as "considered to be so by one having ordinary skill in the art of household vacuums" and/or "at least 90% of the term being modified by 'substantially.'"

The term "generally" used herein is defined as a majority of the modified and described term following the word "generally."

The terms "or" and "and/or" should be interpreted as being inclusive of one or both terms being joined thereby. For example, in the set {A, B}, the phrase "A or B" includes "A," "B," and "A and B."

DETAILED DESCRIPTION OF EMBODIMENTS OF THE DISCLOSED TECHNOLOGY

Embodiments of the disclosed technology include a vacuum producing suction and air blowing simultaneously at a same surface of the device. A pump and compressor work simultaneously to both blow and suck air through a dual-line hose. A pressure gradient is created between the surface of the device and a surface being cleaned, due to high pressure being created by the air blowing, and low pressure being created by the air sucking. This causes dust, dirt, and the like to be pulled from the surface being cleaned and sucked in a suction portal, and into a suction line of the dual-line hose. This can be accomplished with a central vacuum system or standalone vacuum.

Embodiments of the disclosed technology will become clearer when reviewed in connection with the description of the figures herein below.

Figure 1:
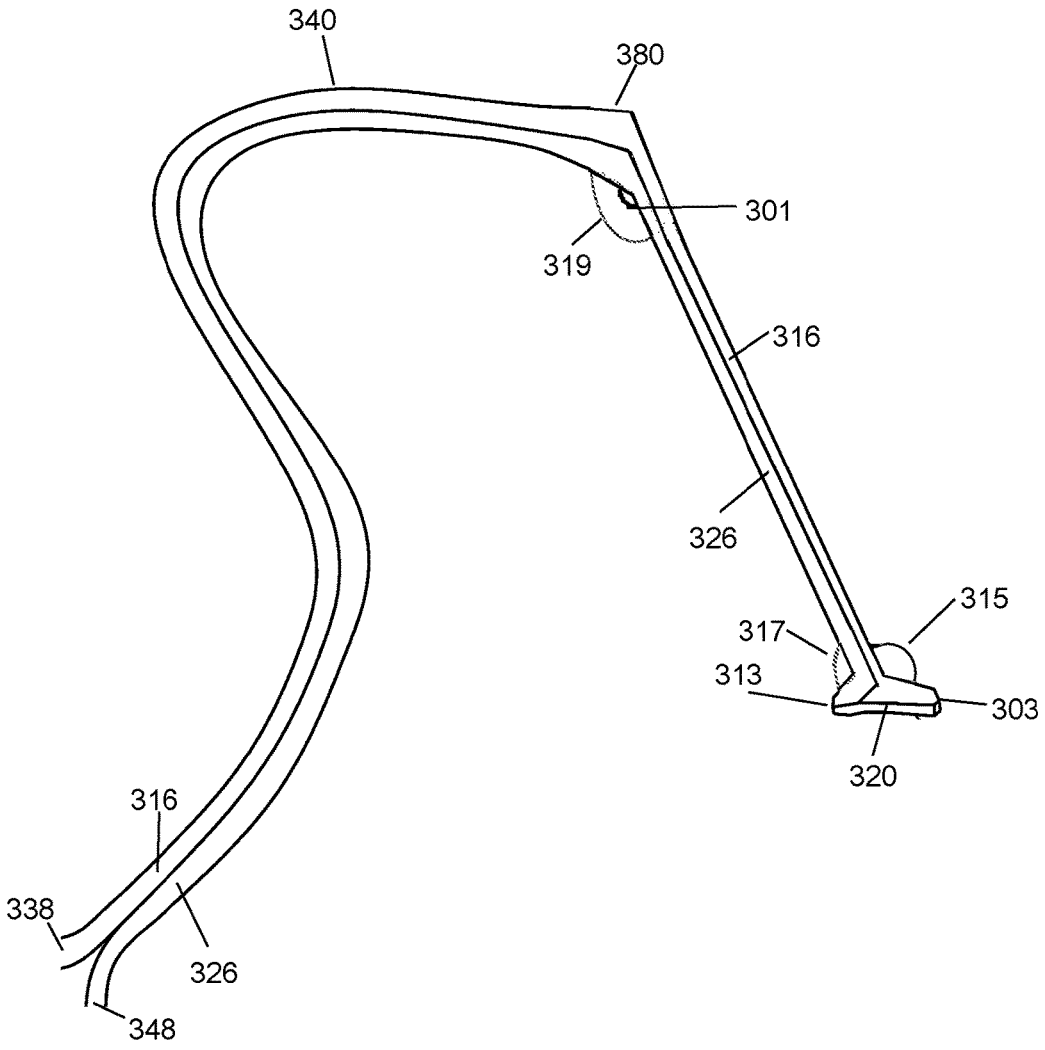
FIG. 1 shows a perspective view of a dual line hose attachment of a vacuum, in an embodiment of the disclosed technology.

FIG. 1 shows a perspective view of a dual line hose attachment of a vacuum, in an embodiment of the disclosed technology. In this embodiment, the vacuum system includes a dual line hose attachment 340 having a first hollow tube used as a vacuum hose 316, a second tube, running alongside (or forming a unitary structure with) the first tube, that is used as an air blowing hose 326. A base 320 is at a terminal end of the dual line hoses 316/326, the base 320 having a generally linear surface 306 forming a "business end" of the vacuum device which runs on or parallel to the ground, during use of the vacuum system. The term "generally" used herein is defined as a majority of the modified and described term following the word "generally." The term "linear surface" as used herein is defined as a surface that is a flat and even plane. A "business end," for purposes of this disclosure, is a surface or end of a device which is held in parallel or directly adjacent to a surface to be cleaned and/or provided with a pressure gradient thereon. In embodiments, a first end 338/348 of the vacuum and air blowing hoses 316/326 operatively attach to a wall mounted vacuum and air blowing port 314/324, which will be shown and discussed with reference to FIGS. 5-7.

Still discussing FIG. 1, a handle 380 is or can be attached to the dual line hose attachment 340 at a location between the wall mounted vacuum port 314 and the base 320. In embodiments of the disclosed technology, the base 320 has a defined front side 303 and a defined back side 313. The handle 380 can include a handle region 380 which can be a position at or near a bend or bendable portion of the dual line hose, where it meets with a firm (non-flexible) portion of the tube, and/or at a terminal end of such a firm portion of the tube. The dual line hose can thus include multiple parts which functionally connect to form a longer tube, parts of which can be flexible and parts of which can be firm. The handle or handle portion 380 can be located on the dual line hose at an end of a firm portion thereof. The vacuum base 320 and an end of the dual line hose attachment 340 meet forming a first and a second angle 315/317, such that the angles 315/317 can be adapted where a person can hold the handle 380 or the dual line hose 340, on a back side 313 of said vacuum base 320, in embodiments of the disclosed technology. The firm portion of the dual-line hose can extend from or at an acute angle 319 to the base 320, thus designated a location which is a "back" side of the device adapted for a person to stand. That is, the back side of the device is the side closest to where a person stands when operating the vacuum cleaner. Further, a trigger switch 301 can be electrically coupled with a compressor and/or a blower to turn on and/or off the device. The trigger switch 301 can alternatively or additionally physically close lines 316 and/or lines 328.

Figure 2:
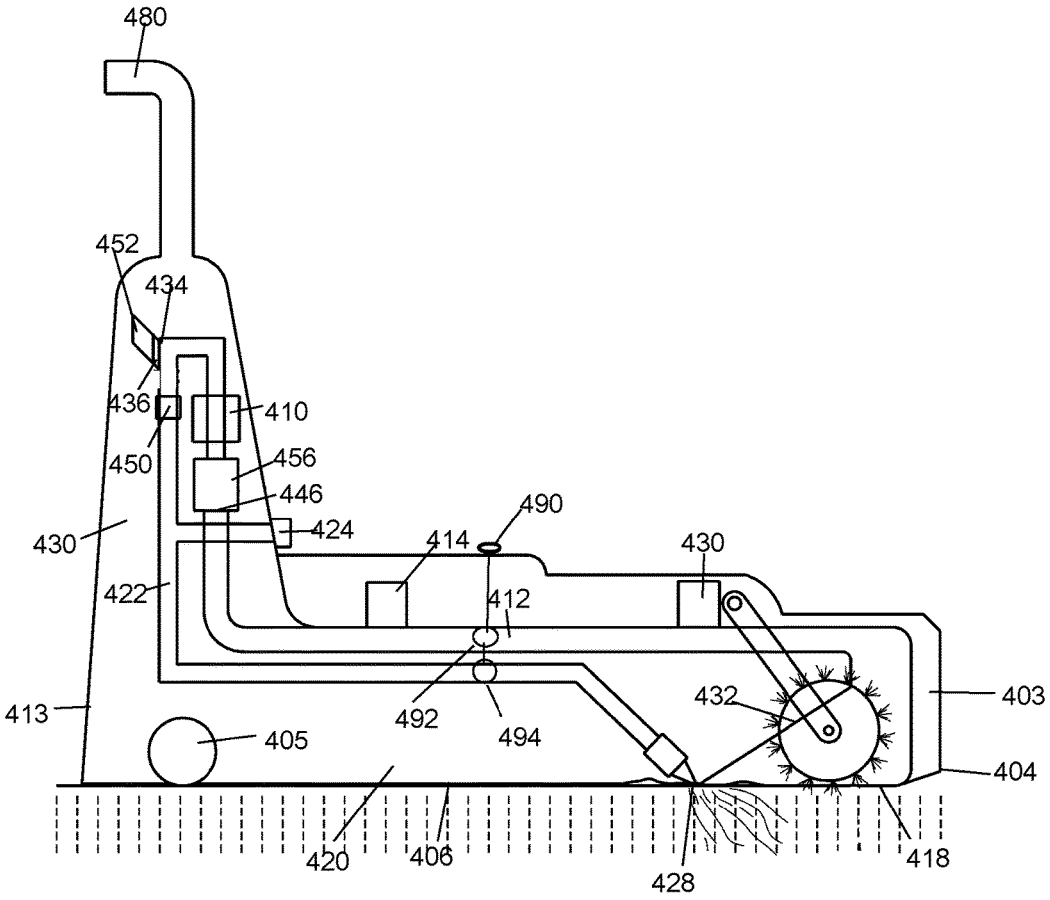
FIG. 2 shows a cutaway side elevation view of a vacuum, in an embodiment of the disclosed technology.

FIG. 2 shows a cutaway side elevation view of a vacuum, in an embodiment of the disclosed technology. The vacuum in this embodiment is shown having a top portion with a handle 480 (a protrusion extending from a larger body, which can be used for manipulating the vacuum), and a base 420 located on an opposite side of the vacuum, with a vacuum body 430 there-between. A vacuum pump 410 can or does operatively connect to vacuum piping 412. The vacuum pump motor 410, in embodiments of the disclosed technology, can provide power between the rates of 3,677 and 5,148 Watts (W) (or approximately 5 to 7 horsepower (hp)), producing the suction. A vacuum compressor motor 450 can or does operatively connect to air blowing piping 422, and provides power between the rates of 1,471 to 2,942 W (or approximately (2 to 4 hp), for the blowing of pressured air in the disclosed technology. In embodiments, the wattage and/or power generated by the vacuum pump motor 410 and the compressor motor 450 is in a ratio between approximately 350% and 125%. The ratio of blowing power to vacuum power may also be 250%, 175%, or 200%. The vacuum pump 410 and compressor 450 can be combined in a unitary motor, or can each exist as an independent motor to produce the suction and pressured air blowing, respectively. A storage container 456 and a first filter 446 are shown operatively placed between the vacuum pump 410 and the vacuum piping 412. The storage container 456 and first filter 446 can be combined as one unit, as shown in FIG. 2.

Still discussing FIG. 2, the vacuum piping 412 operatively connects with a suction portal 418, such that air is diverted from the suction portal 428, through the vacuum piping 412, and through the first filter 446, toward the vacuum pump 410, but holding any debris or non-air particles in the storage container 456. Vacuum piping 412 additionally connects operatively with a fresh air inlet 452 that can or does supplement the air sucked in through the suction portal 418. In embodiments, air can be further diverted from the vacuum piping 412 through a one way valve 434 and from the fresh air inlet 452 through a filter 436 in the direction of the compressor 450. The air blowing piping 422 operatively connects with at least one air blowing portal 428, such that air is diverted from the vacuum compressor 450, through the air blowing piping 422, toward the air blowing portal 428.

The suction portal 418, and the at least one air blowing portal 428 both open into the generally linear surface 306 shown on the bottom of the base 420 in this embodiment, the portals 418/428, each substantially transverse to the generally linear surface 406. A net gain of air pressure due to air flowing out of the at least one air blowing portal 428 and into the suction portal 418 is a maximum of zero. In embodiments of the disclosed technology, a front side 403 and a back side 413 of the base 420 can be designated thereof, with the suction portal 418 being closer to the front side 403 of the base 420 than the air blowing portal 428. Furthermore, an angle of the base 420 and the vacuum body 430 are both adapted such that a person holds the handle 480 on the back side 413 of the base 420, and the air blowing portal 428 is situated closer to the back side 413 on the base 420 than the suction portal 418.

The vacuum of the disclosed technology of FIG. 2 shows a wheel 305 extending downward past the generally linear surface 306, such that when each wheel is engaged with a surface, an equal distance between the ground and each of the suction portal 418 and the at least one air blowing portal 428 is formed. In embodiments, a rotary bar 432 is shown housed inside the base 420, such that a portion of the rotary bar 432 rests on the surface being cleaned. The rotary bar 432 is shown connected with and powered by a rotary bar motor 430, such that the rotary bar 432 can spin and the portion of the rotary bar 432 touching the surface can agitate (lift up) dirt on the surface, and the dirt can be suctioned into the suction portal 418 effectively. The vacuum piping 412 and air blowing piping 422 each have an extension port 414 and 424, respectively, capable of connecting with an attachment tool, in embodiments of the disclosed technology.

Figure 3:
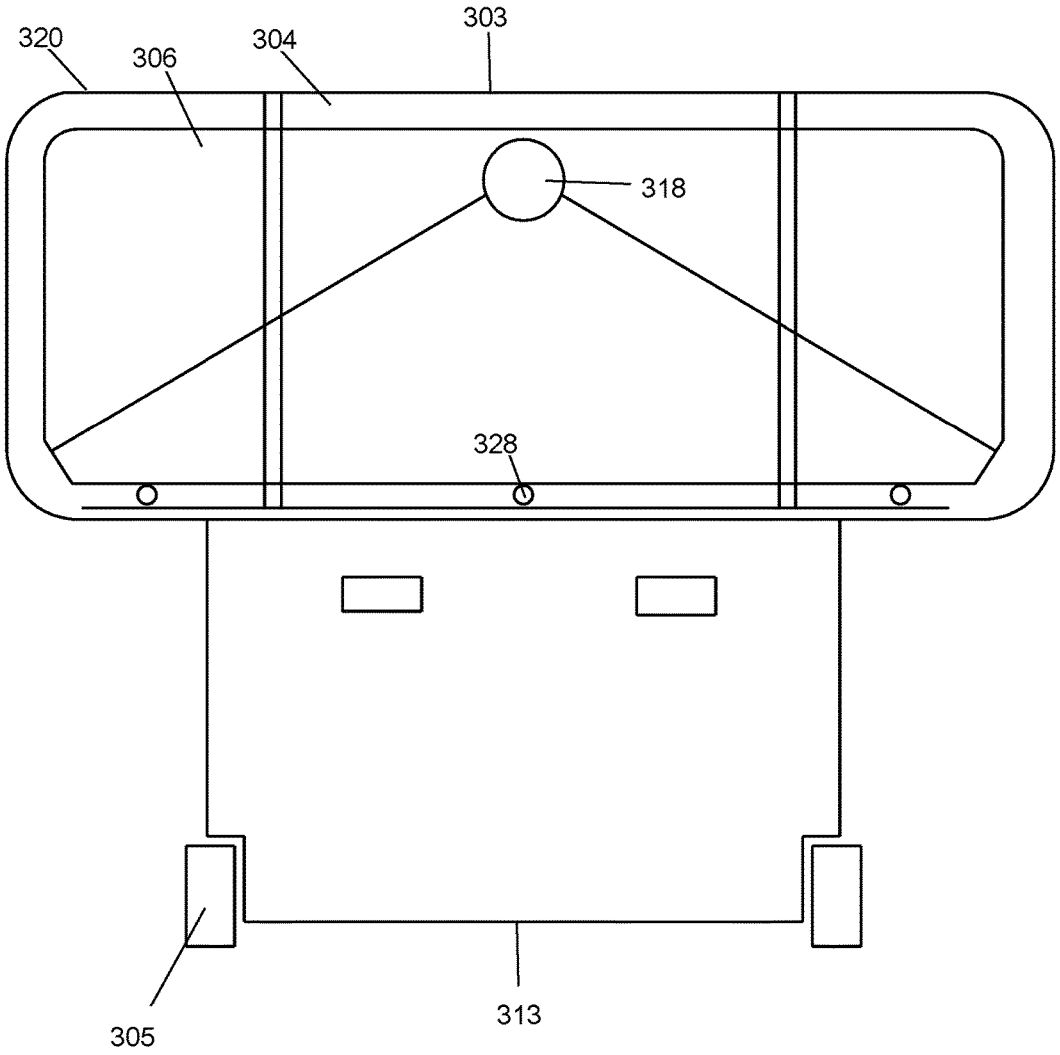
FIG. 3 shows a bottom plan view of a vacuum, in an embodiment of the disclosed technology.

FIG. 3 shows a bottom plan view of a vacuum, in an embodiment of the disclosed technology. The generally linear surface 306 of the base 320 is shown having the suction portal 318 closer to the front side 303 and substantially transverse thereto. Three equally spaced air blowing portals 328 are shown closer to the backside 313 of the generally linear surface and substantially transverse thereto and base 320, in embodiments of the disclosed technology. FIG. 3 shows wheels 305 disposed on a surface adjacent to the generally linear surface 306, and closer to the backside 313 of the base 320 than the front side 303. As each wheel 305 is engaged with a surface, an equal distance between the ground and each of the suction and air blowing portals 318/328 is formed. In embodiments, a floating plastic sealer 304 surrounds the perimeter edge of the generally linear surface 306 of the base 320. The floating plastic sealer 304 can extend to touch the surface for cleaning to prevent or substantially or generally prevent the suction produced by the disclosed technology.

Still discussing FIG. 3, the suction portal 318 that opens into the generally linear surface 306 of the base 320 is or can be connected to the vacuum hose 316 of the dual line hose attachment 340 (shown in FIG. 1), while in other embodiments, the suction portal 318 can be operatively connected with vacuum piping 312 (shown in FIG. 2). In embodiments, the three air blowing portals 328 operatively connect with the air blowing hose 322 of the dual line hose attachment 340 (See FIG. 1). In other embodiments, the three air blowing portals 328 operatively connect with the air blowing piping 326 of the disclosed technology (shown in FIG. 2).

In embodiments, the single suction portal 318 can suction at a rate between 45 and 60 meters per second (m/s) (or approximately 70 and 135 miles per hour (mph)). High pressured air is propelled out of the three equally spaced air blowing portals 328 at a rate between 31 and 60 m/s (or approximately 100 and 135 mph). The air blowing portals 328 and the single suction portal 318 create a triangular pressure region, focusing a pressure gradient from a wide surface region to a narrow surface region. A greater suction gradient is produced at the narrow surface region, the location of the suction portal 318, than at the wide surface region, the location of the three air blowing portals 328. In embodiments, the rate of suction and/or flow and/or pressure gradient created in suction portal 318 and the air blowing portals 328 can be expressed as ratios comparing the rate of blowing to the rate of suction. Ratios comparing rates of blowing to suction can be between 50% and 135%. The ratio of blowing to suction can also be 60%, 85%, or 100%. The rate of air blowing out of the air blowing portals 328 is, in embodiments, greater than the rate of suction in the suction portal 318. In further embodiments, the rate of suction in the suction portal 318 is greater than the rate of high pressured air blowing out of the air blowing portals 328.

Figure 4:
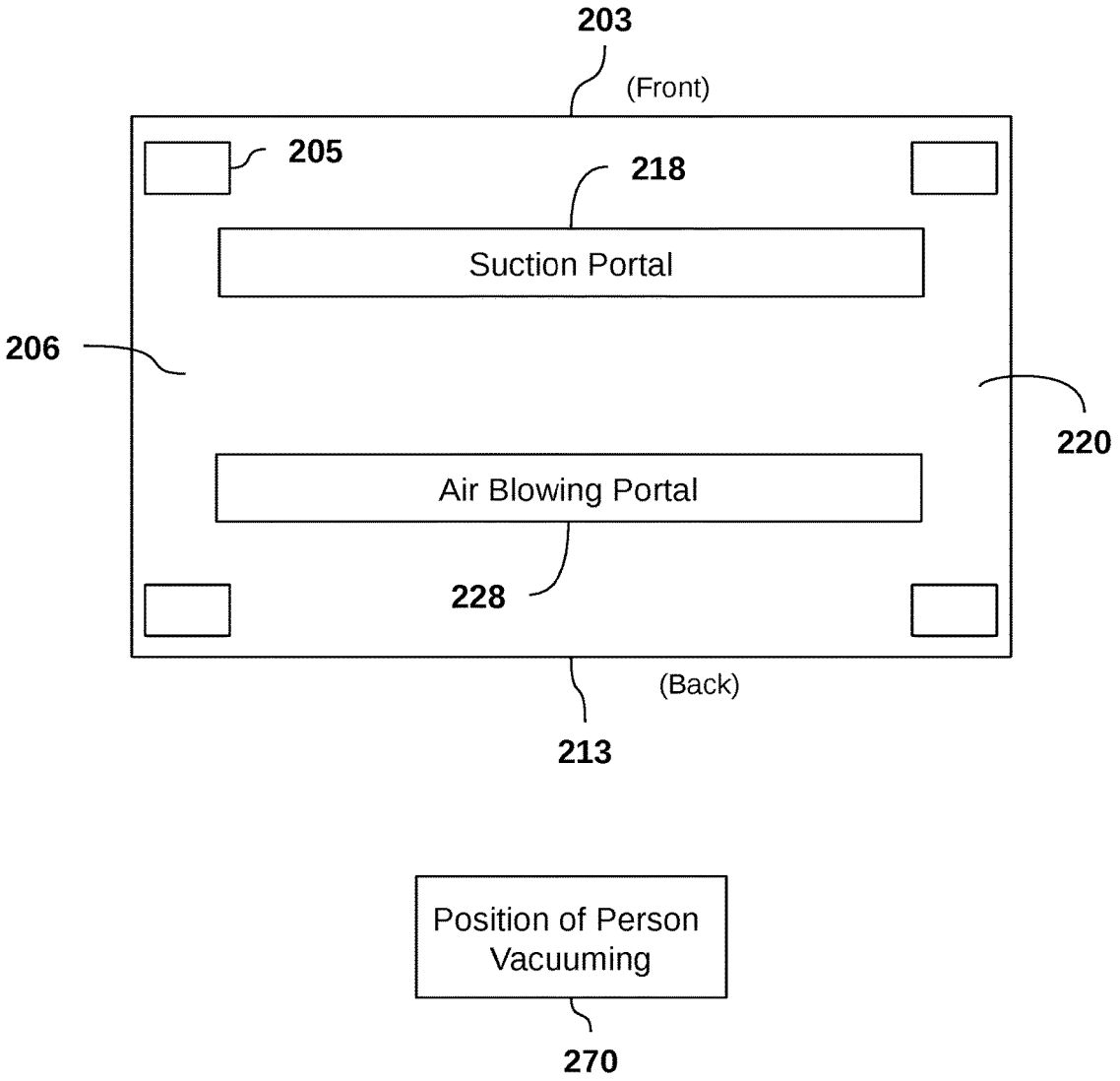
FIG. 4 shows a bottom diagrammatic view of a vacuum or vacuum attachment, in an embodiment of the disclosed technology.

FIG. 4 shows a bottom diagrammatic view of a vacuum or vacuum attachment, in an embodiment of the disclosed technology. The vacuum base 220 is shown having a designated front side 203 and a designated back side 213, with the position of a person vacuuming 270 shown located at the back side 213 of the vacuum, in embodiments of the disclosed technology. A suction portal 218 is shown closer to the front side 203 of the base 220, and an air blowing portal 228 is shown closer to the back side 213 of the base 220, both portals 203/213 opening into the generally linear surface 206 of the base 220, and transverse thereto. The suction portal 218 is or can be connected to a vacuum hose 316 of the dual line hose attachment 340 (shown in FIG. 1), while in other embodiments, the suction portal 218 can be operatively connected with vacuum piping 312 (shown in FIG. 2). In embodiments, the air blowing portal 228 is or can operatively connect with the air blowing hose 325 of the dual line hose attachment 340 (See FIG. 1), or with the air blowing piping 326 of FIG. 2.

Still discussing FIG. 4, the portals 218/228 can create a triangular pressure region, focusing a pressure gradient from a wide surface region to a narrow surface region. A greater suction gradient is produced at the narrow surface region where the suction portal 218 is located, than at the wide surface region, the location of the air blowing portal 228. In embodiments, the rate of suction and/or flow and/or pressure gradient created in suction portal 218 and the air blowing portal 228 is in a ratio between 52% and 135%. The rate of air blowing out of the air blowing portal 228 is, in embodiments, greater than the rate of suction in the suction portal 218. In embodiments, the rate of suction is greater than the rate of air blowing from the air blowing portal 228.

A diverter valve 490 is used in embodiments of the disclosed technology. The diverter valve diverts airflow from one direction to another. The diverter valve 490 prevents air flow in one direction at a time, by way of operating value 492 and/or 494. When a hose is attached to extension port 414 the diverter valve is operated (mechanically, by way of insertion of a hose into the port 414, manually by a user, or otherwise) to shut valve 412, and thus prevent airflow from entering the vacuum piping 412 by way of portal 418. Similarly, when a hose is attached to port 414, the diverter 414 is used to shut off valve 494, preventing air from flowing out through portal 428. As such, when a hose is used/connected to the extension port 414, air flows out (is diverted to) port 424 into a hose, and in through portal 424. That is, air flows through ports 414 and 424 into and out of an extension hose, instead of through 418 and 428, when using the bottom side of the vacuum to clean. The hose used may be the hose shown and described with respect to FIG. 1.

Figure 5:
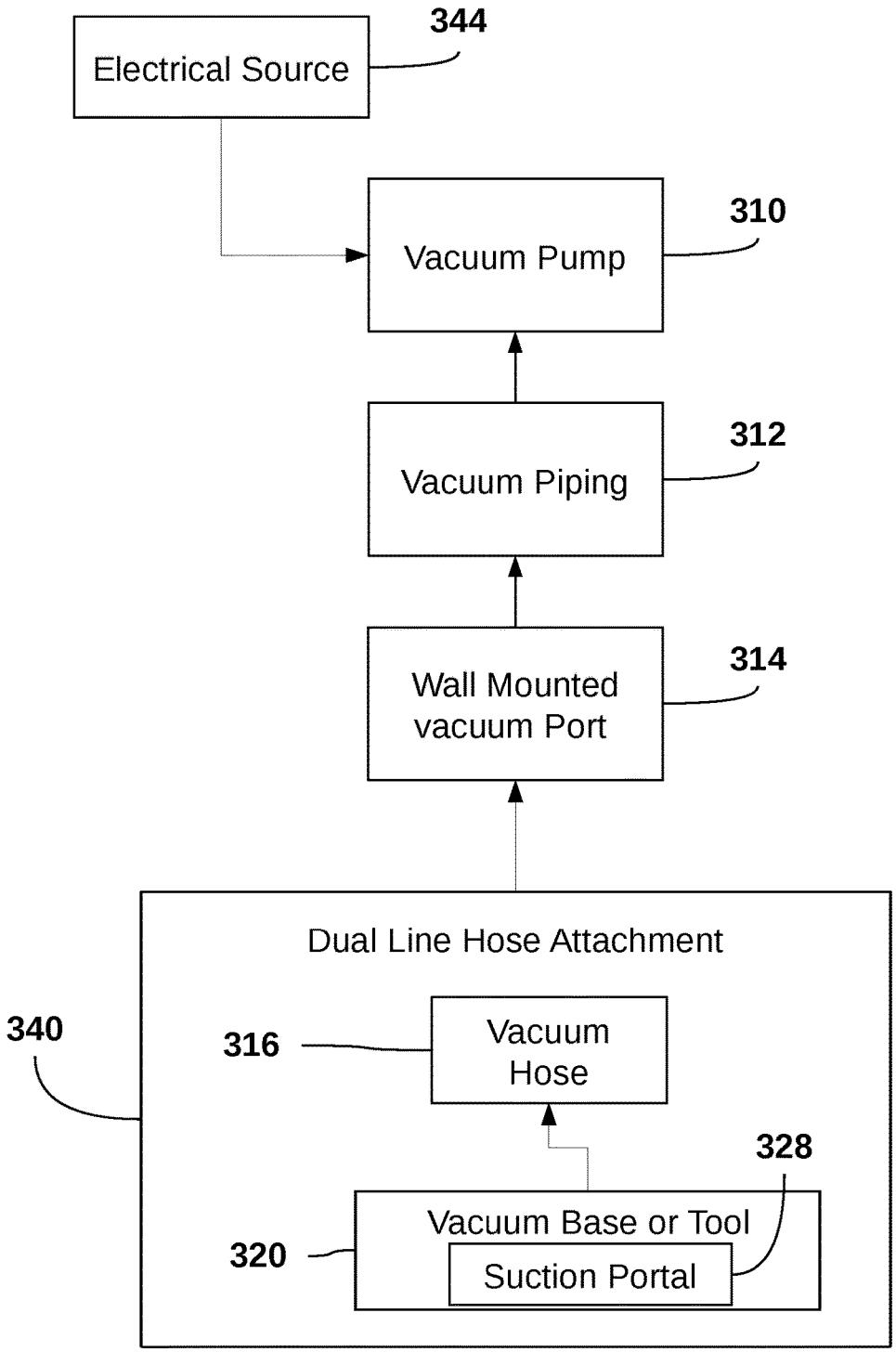
FIG. 5 shows a high level block diagram of a suction portion of a vacuum system, in an embodiment of the disclosed technology.

FIG. 5 shows a high level block diagram of a suction portion of a vacuum system, in an embodiment of the disclosed technology. In an embodiment of the disclosed technology. An electrical source 344 is shown providing power to the vacuum pump 310. It should be understood that an electrical or other power source can be used to power both any motor and/or compressor disclosed herein. The vacuum pump 310 produces suction, forcing air and dirt into the vacuum through the suction portal 328, located on the generally linear surface 306 of the vacuum base or tool 320 of a dual line hose attachment 340 (as further discussed in FIGS. 3-4). Once the air and dirt enter the suction portal 328, the air is routed through a vacuum hose 316 of the dual line hose attachment 340, that is or can be operatively connected with the suction portal 318. The air and dirt continue through a wall mounted vacuum port 314 operatively connected with an end of the vacuum hose 316, into vacuum piping 312, operatively connected with the vacuum port 314 on a first end, and diverting the air toward the vacuum pump 310. "Wall mounted," for purposes of this disclosure, is defined as held stationary relative to a fixed structure in the ground (typically, a building). A wall mounted vacuum portal, blower portal, or combination of same can be on a wall or other stationary surface, and is thus, also fixed in place relative to the building in which it is in.

Figure 6:
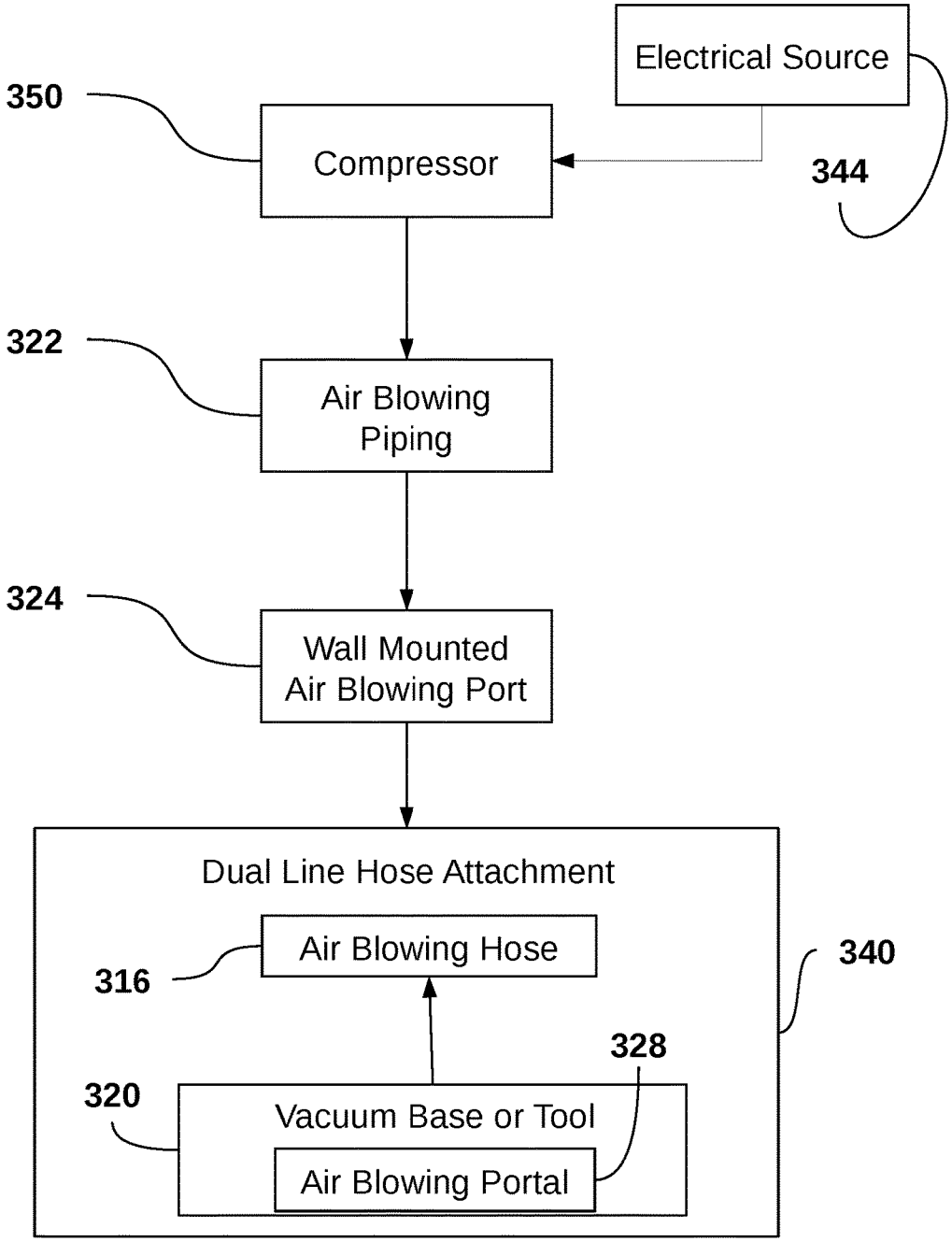
FIG. 6 shows a high level block diagram of a compressor/air blowing portion of a vacuum system, in an embodiment of the disclosed technology.

FIG. 6 shows a high level block diagram of a compressor/air blowing portion of a vacuum system, in an embodiment of the disclosed technology. A compressor 350 produces the high pressured air blowing through air blowing piping 322, operatively connected with a wall mounted air blowing port 324, and continuing through an air blowing hose 326. A first end of the air blowing hose 326 is or can be operatively connected to the wall mounted air blowing port 324, and a second end of the air blowing hose is operatively connected with the air blowing portal 328 that opens into the generally linear surface 306 discussed in FIGS. 3-4. The high pressured air is routed through the air blowing hose 326 and exits through the air blowing portal 328 of the vacuum in the disclosed technology. The compressor 350 is powered by a motor to produce the high pressured air blowing out of the vacuum in embodiments of the disclosed technology.

Figure 7:
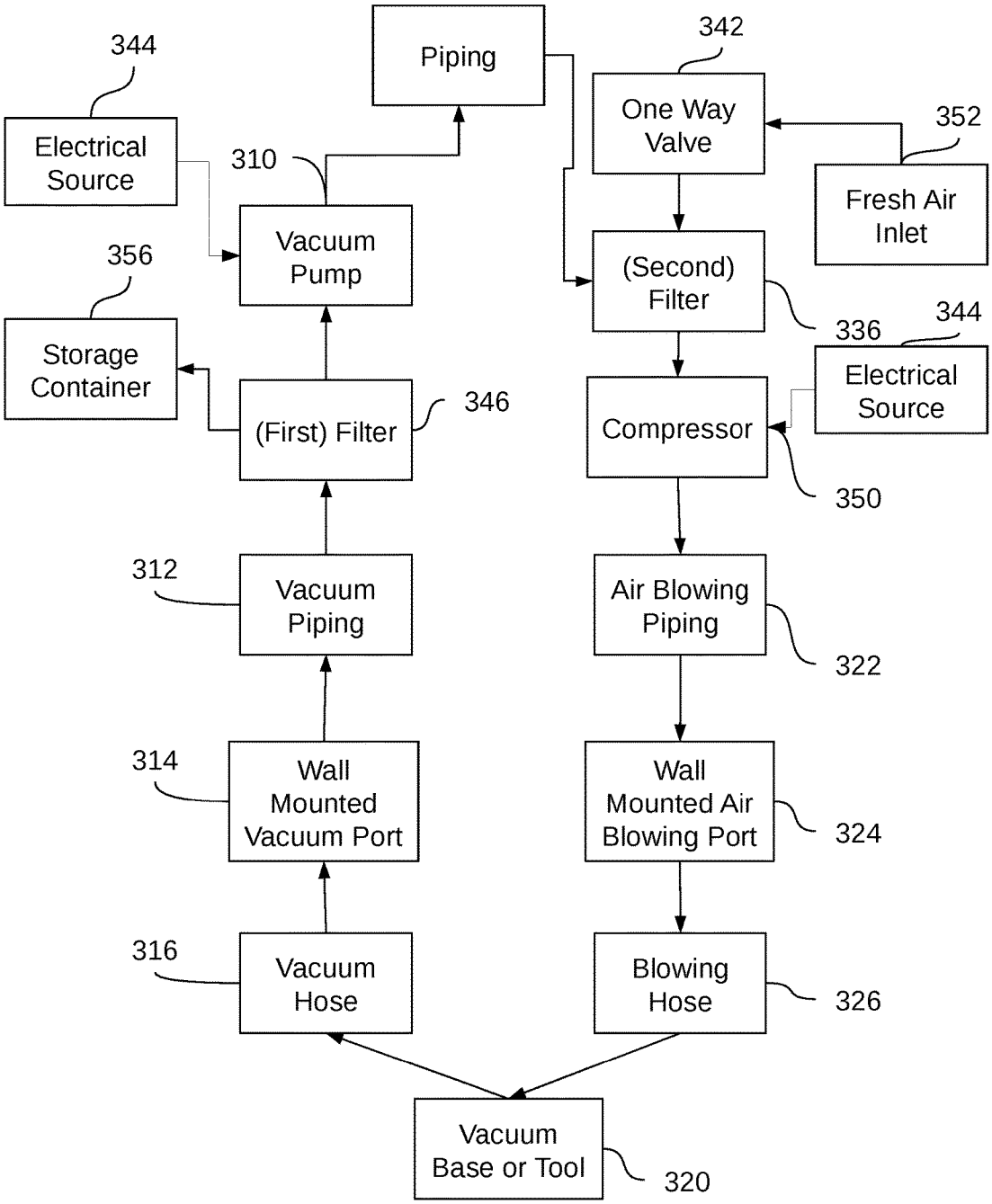
FIG. 7 shows a high level block diagram of both blowing and suction portions of a vacuum system, in an embodiment of the disclosed technology.

FIG. 7 shows a high level block diagram of both blowing and suction portions of a vacuum system, in an embodiment of the disclosed technology. Air and dirt are sucked in through a suction portal 318 (see FIG. 5 above) located on the vacuum base or tool 320 and routed through the vacuum hose 316, operatively connected with the wall mounted vacuum port 314. The air continues through vacuum piping 312, operatively connected with the vacuum port 314, through a first filter 346, and toward the vacuum pump 310 connected with an electrical source 344. In embodiments, dirt or debris are diverted to a storage container 356, while the suctioned air is diverted past the vacuum pump 310, through piping where the exhaust air can pass through a second filter 336.

Still discussing FIG. 7, the high pressured air blown out of the at least one air blowing portal 328 is sourced from the fresh air inlet 352 and from the exhaust air sucked in by the vacuum action of the disclosed technology, produced by the vacuum pump 310. The air from both sources is rerouted toward the compressor 350, producing the air pressure, and then routed through the air blowing piping 322, housing the air blowing outward, toward the air blowing portals 328, which open into the generally linear surface 306 (shown in FIGS. 3 and 4) of the base 320 in embodiments of the disclosed technology. A one way valve 342 that is or can be operatively placed between the fresh air inlet 352 and the air blowing piping 322 diverts air toward the compressor 350 and through the air blowing piping 322, toward the vacuum base 320. The one way valve 342 allows air to enter through the fresh air inlet 352, but prevents air from leaving through it. In embodiments, a first end 348 (shown in FIG. 1) of the air blowing hose 326 operatively attaches to a wall mounted air blowing port 324, and a second end of the air blowing hose 326 operatively couples to at least one air blowing portal 328 (shown in FIG. 3) on the generally linear surface 306 (shown in FIGS. 3 and 4) of the vacuum base 320 in the disclosed technology.

Figure 8:
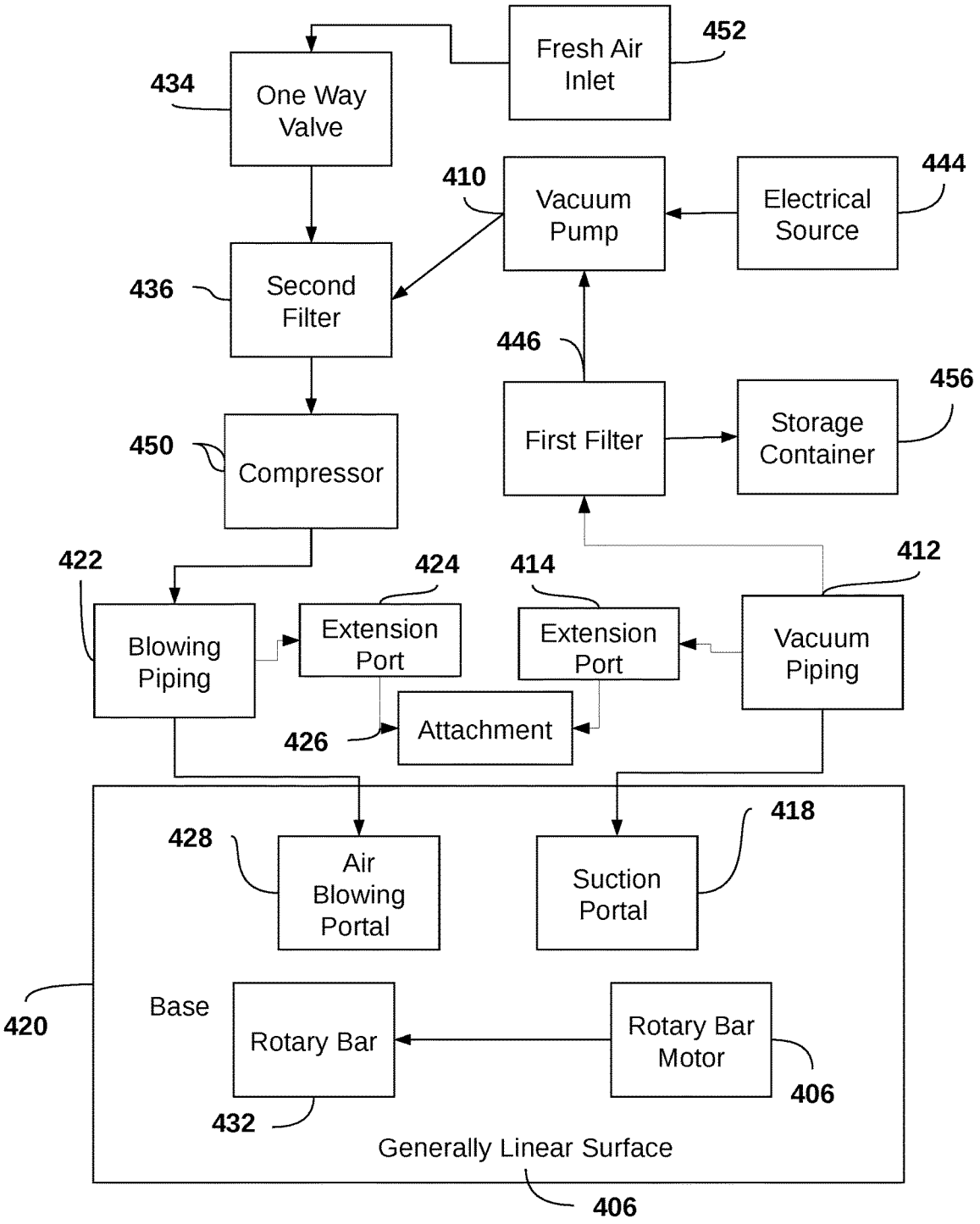
FIG. 8 shows a high level block diagram of the vacuum systems with either attachments or a vacuum base being used, in an embodiment of the disclosed technology.

FIG. 8 shows a high level block diagram of the vacuum systems with either attachments or a vacuum base being used, in an embodiment of the disclosed technology. Air and dirt are sucked in through a suction portal 418 located on the vacuum base 420, and routed through vacuum piping 412, operatively connected with the vacuum portal 418. The air continues through a first filter 446, and toward a vacuum pump 410, connected with an electrical source 444. In embodiments, dirt or debris are diverted to a storage container 456, while the suctioned air is diverted past the vacuum pump 410, through piping where the exhaust air can pass through a second filter 436.

The high pressured air blown out of the at least one air blowing portal 428 is sourced from the fresh air inlet 452 and also from the exhaust air sucked in by the vacuum of the disclosed technology. The air from both sources is rerouted toward the compressor 450 which produces the air pressure, and then routed through the air blowing piping 422, housing the air that is or can be blowing outward, toward the air blowing portal 428, which opens into the generally linear surface 406 of the base 420, in embodiments of the disclosed technology. Fresh air entering through the fresh air inlet 452 pass through a one way valve 434 that is or can be operatively placed between the fresh air inlet 452 and the air blowing piping 422. The one way valve 434 diverts air toward the compressor 450 and through the air blowing piping 422, toward the vacuum base 420. The one way valve 442 allows air to enter through the fresh air inlet 452, but prevents air from leaving through it.

Still discussing FIG. 8, an extension port 424 can be operatively connected with the air blowing piping 422, for allowing the connecting of an attachment tool 426 to the extension port 424. An attachment tool 426 functions similarly to the device shown in FIG. 4, having a generally planar surface with an air blowing portal and a suction portal there-on. An additional extension port 414 can be operatively connected with the vacuum piping 412, for allowing the connection of an attachment tool to the extension port 414. In embodiments, a rotary bar 432 is housed inside the base 420, and a portion of the rotary bar 432 is in contact with the surface to be cleaned. In embodiments, the rotary bar 432 is connected with and powered by a rotary bar motor 430, such that the rotary bar 432 can spin and the portion of the rotary bar 432 touching the surface can gently agitate (lift up) dirt on the surface, and the dirt can be suctioned into the suction portal 418. Due to the air pressure gradient created between the blowing and suction, the rotary bar can be raised from the ground further, as the pressure gradient is increased. In further embodiments, a rotary bar is unnecessary or optional. The air blowing outward additionally prevents the vacuum from getting stuck to the surface being cleaned as a result of strong suction, and further allows the close seal of the base 320 with the surface cleaned.

Figure 9:
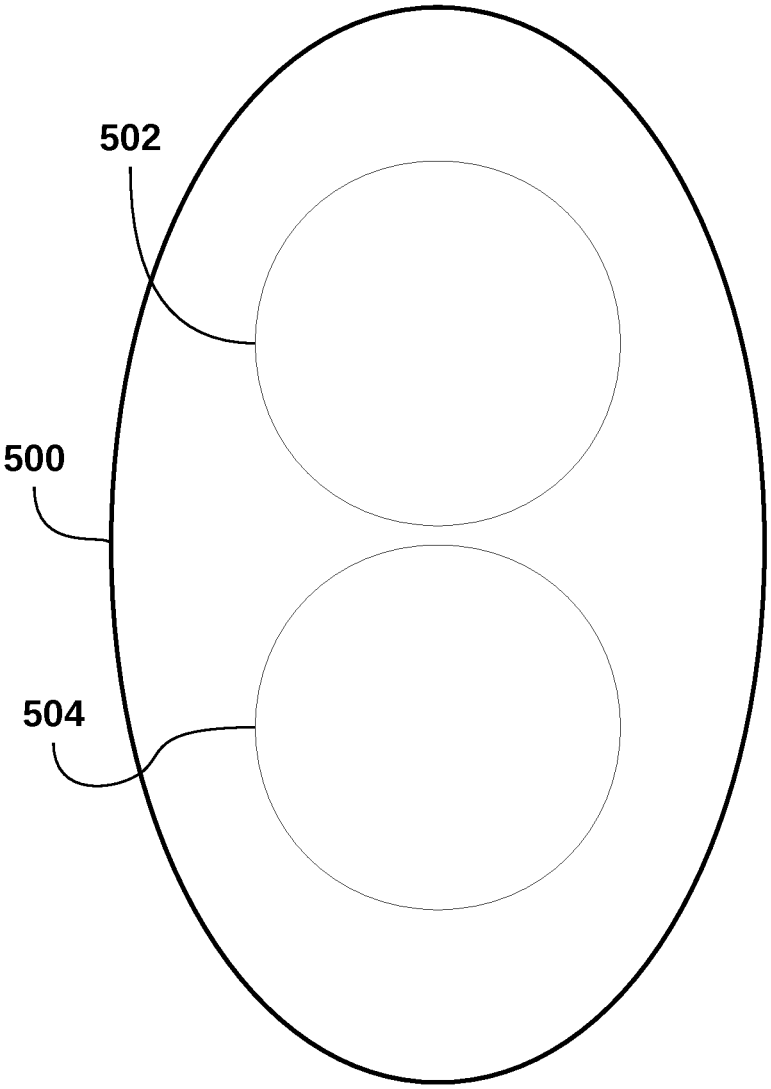
FIG. 9 shows a wall mount vacuum and blower port used in embodiments of the disclosed technology.

FIG. 9 shows a wall mount vacuum and blower port used in embodiments of the disclosed technology. The wall mount 500 is fixed in position to a building with two portals, a vacuum portal 502 and air blowing portal 504. A hose, such as shown in FIG. 1, attaches thereto with each line of the hose attaching to one of the portals on the wall mount. Alternatively, FIG. 9 can be a cross section view of a dual-line hose, used in embodiments of the disclosed technology. Items 502 and 504 thus show lines of the hose and item 500 shows an encasement around the lines of the hose, forming a unitary hose with two air passageways, each having air flowing in an opposite direction from one another.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope.

Combinations of any of the methods, systems, and devices described herein above are also contemplated and within the scope of the invention.

I claim:

1. A vacuum comprising:

a vacuum pump and compressor;

a first pipe and a second pipe operatively connected, respectively, to said vacuum pump and compressor at a first end of each said pipe, and further operatively connected, respectively, to a first and second portal at a second end of each said pipe;

wherein said first portal and said second portal open on a same side of a business end of a vacuum cleaner and a direction of airflow at said first portal is opposite a direction of airflow at said second portal such that said first portal blows air and said second portal sucks air; and wherein said first portal is at least three first portals which creates with said single second portal a triangular pressure region focusing a pressure gradient from a wide surface region to a narrow surface region, such that a greater suction gradient is produced at said narrow surface region, location of said second portal, than at said wide surface region, location of said three first portals.

2. The vacuum of claim 1, wherein said business end further comprises a vacuum base having a generally linear surface, and wherein said first portal and said second portal open into said generally linear surface of said vacuum base substantially transverse thereto.

3. The vacuum of claim 2, wherein said vacuum base further comprises a front and back side thereof, as defined by at least an angle of a handle of said vacuum designating a location of a user nearer to said back side of said vacuum; and wherein said second portal is positioned closer to said front side of said vacuum base than said first portal.

4. The vacuum of claim 3, wherein said second portal is operatively connected with said vacuum piping, such that air is pulled from said second portal toward said vacuum pump; and said first portal of said vacuum is operatively connected with said air blowing piping, such that air is propelled from said compressor toward said first portal.

5. The vacuum of claim 4, wherein said second portal is a single portal situated closer to said front side of said generally linear surface than said first portal, said second portal sucking air, and wherein said generally linear surface further comprises three first portals blowing air and positioned opposite on the back portion of said generally linear surface.

6. The vacuum of claim 1, wherein said suction gradient produced at said location of said suction portal is produced between said generally linear surface and the ground, such that said suction gradient is stronger than said pressure gradient produced at said location of said three air blowing portals, produced between said generally linear surface and the ground.

7. The vacuum of claim 1, wherein said pressure gradient produced at said location of said three air blowing portals is produced between said generally linear surface and the ground, such that said pressure gradient is stronger than said suction gradient produced at said location of said suction portal, between said generally linear surface and the ground.

8. The vacuum of claim 1, further comprising:

a wall mounted vacuum port, a wall mounted air blowing port, and a dual line hose attachment having a vacuum hose, an air blowing hose, and said vacuum base;

wherein a first end of said vacuum hose operatively attaches to said wall mounted vacuum port, and a second end of said vacuum hose operatively attaches to said second portal on said generally linear surface of said vacuum base; and wherein a first end of said air blowing hose operatively attaches to said air blowing port, and a second end of said air blowing hose operatively couples to said first portals on said generally linear surface of said vacuum base.

9. A central vacuum system comprising:

a vacuum pump operatively connected to vacuum piping;

a compressor operatively connected to air blowing piping;

a storage container operatively connected to said vacuum piping;

a wall mounted vacuum port operatively connected to said vacuum piping;

a wall mounted air blowing port operatively connected to said air blowing piping;

a dual line hose further comprising a first line of said dual line hose operatively connected with said wall mounted vacuum port, and a second line of said dual line hose operatively connected with said wall mounted air blowing port;

a handle at said dual line hose between said wall mounted vacuum port and a vacuum base, said vacuum base having a generally linear surface;

a suction portal opening into said generally linear surface and substantially transverse to said generally linear surface, said suction portal being operatively connected to said first line of said dual line hose and to said vacuum pump; and at least one air blowing portal opening into said generally linear surface substantially planar with said suction portal and substantially transverse to said generally linear surface, operatively connected to said second line of said dual line hose and to said compressor;

wherein said vacuum base comprises a defined front and back side thereof, and said suction portal is closer to said front side of said vacuum base than said at least one air blowing portal; and said generally linear surface further comprising three air blowing portals positioned on the backside portion of said generally linear surface, positioned opposite of a single suction portal situated along a front side portion of said generally linear surface.

10. The vacuum of claim 9, wherein said vacuum base comprises a defined front and back side thereof, and said suction portal is closer to said front side of said vacuum base than said at least one air blowing portal.

11. The vacuum of claim 10, wherein an angle of said vacuum base and said dual line hose attachment are adapted such that a person holds said handle on a back side of said vacuum base, and said air blowing portal is situated on said vacuum base closer to said back side than said suction portal.

12. The vacuum of claim 9, wherein said air blowing portals and said suction portal create a triangular pressure region focusing a pressure gradient from a wide surface region to a narrow surface region, such that a greater suction gradient is produced at said narrow surface region, location of said suction portal, than at said wide surface region, location of said three air blowing portals.

13. The vacuum system of claim 9, wherein the dual line hose attachment further comprises at least one wheel extending past said generally linear surface such that when said at least one wheel is engaged with the ground, an equal distance between said ground and each of said suction portal and said air blowing portal is formed.

14. A vacuum comprising:

a top portion having a handle disposed on an opposite side of a base of said vacuum with a vacuum body therebetween;

a vacuum pump operatively connected to vacuum piping, and a vacuum compressor operatively connected to air blowing piping;

a storage container operatively placed between said vacuum pump and said vacuum piping;

at least one suction portal opening into a bottom generally linear surface of said base and substantially transverse thereto;

at least one air blowing portal opening into said generally linear surface of said base and substantially transverse thereto, wherein a net gain of air pressure due to air flowing out of said at least one air blowing portal and into said at least one air suction portal is a maximum of zero;

wherein said suction portal of said vacuum is operatively connected with said vacuum piping, such that air is pulled from said suction portal toward said vacuum pump, and said air blowing portal of said vacuum is operatively connected with said air blowing piping, such that air is propelled from said vacuum compressor toward said air blowing portal and wherein said at least one air blowing portal is three air blowing portals positioned on the backside portion of said generally linear surface, positioned opposite said at least one suction portal which is situated along a front side portion of said generally linear surface.

15. The vacuum of claim 14, wherein said base comprises a designated front and back side thereof, and said suction portal is closer to said front side of said base than said air blowing portal.

16. The vacuum of claim 15, wherein an angle of said base and said vacuum body are adapted such that a person holds said handle on a back side of said base, and said air blowing portal is situated on said base closer to said back side than said suction portal.

17. The vacuum system of claim 14, further comprising a plurality of wheels extending past said generally linear surface, such that when each wheel is engaged with the ground, an equal distance between said ground and each of said suction portal and said air blowing portal is formed.

18. The vacuum in claim 17, further comprising a floating plastic sealer surrounding said generally linear surface where a vacuum edge meets a surface substantially preventing.

* * * * *